US007255292B2

(12) United States Patent
Saidman

(10) Patent No.: US 7,255,292 B2
(45) Date of Patent: Aug. 14, 2007

(54) MODULE AND NOZZLE FOR DISPENSING CONTROLLED PATTERNS OF LIQUID MATERIAL

(75) Inventor: Laurence B. Saidman, Duluth, GA (US)

(73) Assignee: Nordson Corporation, Westlake, OH (US)

( * ) Notice: Subject to any disclaimer, the term of this patent is extended or adjusted under 35 U.S.C. 154(b) by 688 days.

(21) Appl. No.: 10/716,720

(22) Filed: Nov. 19, 2003

(65) Prior Publication Data

US 2004/0069868 A1 Apr. 15, 2004

Related U.S. Application Data

(60) Continuation of application No. 10/145,522, filed on May 14, 2002, now Pat. No. 6,651,906, which is a division of application No. 09/571,703, filed on May 15, 2000, now Pat. No. 6,435,425.

(51) Int. Cl.

| | |
|---|---|
| ***B05B 1/28*** | (2006.01) |
| ***B05B 7/10*** | (2006.01) |
| ***B05B 1/14*** | (2006.01) |
| ***B05B 1/04*** | (2006.01) |

(52) U.S. Cl. ..... 239/290; 239/299; 239/399; 239/590.5; 239/597; 239/595; 239/598

(58) Field of Classification Search ..... 239/290, 239/299, 399, 597, 598, 599, 601, 590.5, 239/592, 593, 594, 595, 596

See application file for complete search history.

(56) References Cited

U.S. PATENT DOCUMENTS 4,031,854 A 6/1977 Sprague, Jr. ..... 118/641
4,098,632 A * 7/1978 Sprague, Jr. ..... 156/295
4,135,903 A 1/1979 Ohsato et al. ..... 65/5
4,185,981 A 1/1980 Ohsato et al. ..... 65/5

(Continued)

FOREIGN PATENT DOCUMENTS

EP 0936000 8/1999

(Continued)

OTHER PUBLICATIONS

Syang-Peng Rwei, *Dog-Legging in the Melt Spinning Process*, Polymer Engineering and Science, vol. 38, No. 2, pp. 341-347, Feb. 1998*.

(Continued)

*Primary Examiner*—Davis Hwu
(74) *Attorney, Agent, or Firm*—Wood, Herron Evans, L.L.P.

(57) ABSTRACT

A liquid dispensing module and nozzle or die tip for discharging at least one liquid filament. The nozzle includes a wedge-shaped member having a pair of side surfaces converging to an apex. A liquid discharge passage extends along an axis through the wedge-shaped member and through the apex. The wedge-shaped member extends in a radially asymmetrical manner around the liquid discharge passage. Four air discharge passages are positioned at the base of the wedge-shaped member. At least one air discharge passage is positioned adjacent each of said side surfaces and each of the air discharge passages is angled in a compound manner generally toward the liquid discharge passage and offset from the axis of the liquid discharge passage.

10 Claims, 9 Drawing Sheets

U.S. PATENT DOCUMENTS

| | | | | |
|---|---|---|---|---|
| 4,785,996 | A | 11/1988 | Ziecker et al. | 239/298 |
| 4,815,660 | A | 3/1989 | Boger | 239/8 |
| 4,844,003 | A | 7/1989 | Slautterback et al. | 118/323 |
| 4,969,602 | A | 11/1990 | Scholl | 239/298 |
| RE33,481 | E | 12/1990 | Ziecker et al. | 339/298 |
| 4,983,109 | A | 1/1991 | Miller et al. | 425/7 |
| 5,065,943 | A | 11/1991 | Boger et al. | 239/298 |
| 5,102,484 | A * | 4/1992 | Allen et al. | 156/244.11 |
| 5,169,071 | A | 12/1992 | Boger et al. | 239/296 |
| 5,171,512 | A | 12/1992 | Mende et al. | 264/555 |
| 5,194,115 | A | 3/1993 | Ramspeck et al. | 156/578 |
| 5,267,693 | A | 12/1993 | Dickey | 239/417.3 |
| 5,342,647 | A | 8/1994 | Heindel et al. | 427/2.31 |
| 5,785,258 | A | 7/1998 | Akin et al. | 239/590 |
| 5,882,573 | A | 3/1999 | Kwok et al. | 264/510 |
| 5,902,540 | A | 5/1999 | Kwok | 264/555 |
| 5,904,298 | A | 5/1999 | Kwok et al. | 239/135 |
| 5,921,476 | A | 7/1999 | Akin et al. | 239/590 |
| 6,149,076 | A | 11/2000 | Riney | 239/135 |
| 6,210,141 | B1 | 4/2001 | Allen | 425/7 |
| 6,308,864 | B1 | 10/2001 | Messer | 222/137 |
| 6,322,630 | B1 | 11/2001 | Carroll et al. | 118/681 |
| 6,435,425 | B1 | 8/2002 | Saidman | 239/290 |

FOREIGN PATENT DOCUMENTS

| | | | |
|---|---|---|---|
| GB | 0792744 | A2 | 3/1997 |
| JP | 11244774 | A | 9/1999 |
| WO | 99/59732 | | 11/1999 |

OTHER PUBLICATIONS

J&M Laboratories, *Durastitch™ Technology*, New Product Release Manual, Feb. 1997*.

Rajiv S. Rao et al., *Vibration and Stability In the Melt Blowing Process*, Ind. Eng. Chem., 32, pp. 3100-3111, 1993*.

* cited by examiner

MODULE AND NOZZLE FOR DISPENSING CONTROLLED PATTERNS OF LIQUID MATERIAL

This application is a continuation of U.S. patent application Ser. No. 10/145,522 filed May 14, 2002 now U.S. Pat. No. 6,651,906 and entitled MODULE AND NOZZLE FOR DISPENSING CONTROLLED PATTERNS OF LIQUID MATERIAL, which is a divisional of application Ser. No. 09/571,703 filed May 15, 2000 (now U.S. Pat. No. 6,435,425), the disclosures of which are fully incorporated herein by reference

FIELD OF THE INVENTION

The present invention generally relates to a liquid material dispensing apparatus and nozzle and, more specifically, to an apparatus and nozzle for dispensing controlled patterns of liquid adhesive strands or filaments.

BACKGROUND OF THE INVENTION

Many reasons exist for dispensing liquid adhesives, such as hot melt adhesives, in the form of a thin filament or strand with a controlled pattern. Conventional patterns used in the past have been patterns involving a swirling effect of the filament by impacting the filament with a plurality of jets of air. This is generally known as controlled fiberization or CF™ in the hot melt adhesive dispensing industry. Controlled fiberization techniques are especially useful for accurately covering a wider region of a substrate with adhesive dispensed as single filaments or as multiple side-by-side filaments from nozzle passages having small diameters, such as on the order of 0.010 inch to 0.060 inch. The width of the adhesive pattern placed on the substrate can be widened to many times the width of the adhesive filament itself. Moreover, controlled fiberization techniques are used to provide better control of the adhesive placement. This is especially useful at the edges of a substrate and on very narrow substrates, for example, such as on strands of material such as Lycra used in the leg bands of diapers. Other adhesive filament dispensing techniques and apparatus have been used for producing an oscillating pattern of adhesive on a substrate or, in other words, a stitching pattern in which the adhesive moves back-and-forth generally in a zig-zag form on the substrate. These dispensers or applicators have a series of liquid and air orifices arranged on the same plane.

Conventional swirl nozzles or die tips typically have a central adhesive discharge passage surrounded by a plurality of air passages. The adhesive discharge passage is centrally located on a protrusion which is symmetrical in a full circle or radially about the adhesive discharge passage. A common configuration for the protrusion is conical or frustoconical with the adhesive discharge passage exiting at the apex. The air passages are typically disposed at the base of the protrusion. The air passages are arranged in a radially symmetric pattern about the central adhesive discharge passage, as in the protrusion itself. The air passages are directed in a generally tangential manner relative to the adhesive discharge passage and are all angled in a clockwise or counterclockwise direction around the central adhesive discharge passage.

Conventional meltblown adhesive dispensing apparatus typically comprises a die tip having multiple adhesive or liquid discharge passages disposed along an apex of a wedge-shaped member and air passages of any shape disposed along the base of the wedge-shaped member. The wedge-shaped member is not a radially symmetric element. Rather, it is typically elongated in length relative to width. The air is directed from the air discharge passages generally along the side surfaces of the wedge-shaped member toward the apex and the air impacts the adhesive or other liquid material as it discharges from the liquid discharge passages to draw down and attenuate the filaments. The filaments are discharged in a generally random manner.

Meltblown style dispensers provide a convenient and cost effective platform for discharging a liquid material, such as hot melt adhesive or another material. The air discharge passages of meltblown dispensers are typically arranged symmetrically on either side of and at the base of the wedge-shaped member, i.e., in a different plane than the liquid discharge passages to attenuate the filaments. However, effectively controlled swirling of adhesive filaments from this style of applicator has not been developed to date. It would therefore be desirable to provide a meltblown style dispenser for producing a controlled swirling of the liquid filaments.

SUMMARY OF THE INVENTION

The present invention provides a meltblown style applicator with the capability of producing a controlled swirling of the liquid filament. This results in repeatable filament orientation with improved edge control. Further, the invention provides a predictable relationship between a specific geometric configuration of liquid and air discharge passages and the resulting pattern width and frequency. Thus, the nozzle configuration can be controlled to give a tighter, high frequency filament pattern or a more open, lower frequency filament pattern.

The present invention generally provides a liquid dispensing module or applicator for discharging at least one liquid filament onto a moving substrate with a swirled pattern. The dispensing module includes a dispenser or module body for receiving pressurized liquid and air and a nozzle is coupled to the module body. The nozzle comprises a nozzle body having a first side and a second side with the first side coupled to the module body and including a liquid supply port and an air supply port coupled with respective liquid and air supply passages of the module body. In the preferred embodiment, the first and second sides are respectively located on perpendicular planes of the nozzle body, but other configurations may be used as well. A wedge-shaped member is located on the second side of the nozzle body and includes a base, an apex and a pair of side surfaces converging toward the apex. A liquid discharge passage extends along an axis through the apex of the wedge-shaped member. The liquid discharge passage communicates with the liquid supply port of the nozzle body. The wedge-shaped member extends in a radially asymmetrical manner around the liquid discharge passage. The nozzle body further includes a plurality of air discharge passages positioned adjacent the base of the wedge-shaped member. At least two of the air discharge passages are positioned adjacent each of the side surfaces and each of the air discharge passages is angled in a direction generally toward the liquid discharge passage. Each air discharge passage is also offset from the axis of the liquid discharge passage.

In the preferred embodiment, the nozzle body includes four of the air discharge passages positioned in a generally square pattern about the liquid discharge passage. Two of the air discharge passages are positioned at the base adjacent one of the side surfaces and two of the air discharge passages are positioned at the base adjacent the other of the side surfaces. Each of the air discharge passages is offset by the same distance from the axis of the liquid discharge passage. The air discharge passages positioned at diagonally opposed corners of the square pattern are symmetrically positioned relative to the liquid discharge passage. Each of the air discharge passages are offset from the axis of the liquid discharge passage by a distance at least equal to the radius of the liquid discharge passage. The wedge-shaped member is preferably formed integrally with the nozzle body, such as through extrusion or machining techniques. Especially when dispensing hot melt adhesive materials, the liquid discharge passage has a diameter of between about 0.010 inch and about 0.060 inch and the air discharge passages are each offset from the axis of the liquid discharge passage by a minimum distance of about 0.005 inch to about 0.030 inch up to a maximum of about 0.060 inch.

The inventive concepts apply to dispensing modules having one or more sets of the liquid and air discharge passages. For many applications, it will be desirable to provide a nozzle having multiple side-by-side sets of liquid and air discharge passages with each set configured as described above. Each set may be arranged with respect to separate wedge-shaped members or multiple sets of liquid and air discharge passages may be arranged along the same wedge-shaped member. In each case, a desirable swirled liquid filament pattern is achieved and, moreover, due to the unique configuration of air and liquid discharge passages on opposite sides of a radially asymmetrical wedge-shaped member, a nearly linear relationship exists between the offset dimension, which is defined between the air discharge passages and the axis of the liquid discharge passage, and the resulting pattern width and frequency. As a result, different configurations of the air and liquid discharge passage may be made with precisely predictable results in terms of both swirled pattern width perpendicular to the substrate movement and oscillation frequency parallel to the movement of the substrate of the swirled pattern.

These and other features, objects and advantages of the invention will become more readily apparent to those of ordinary skill in the art upon review of the following detailed description, taken in conjunction with the accompanying drawings.

DETAILED DESCRIPTION OF PREFERRED EMBODIMENTS

Figure 1:
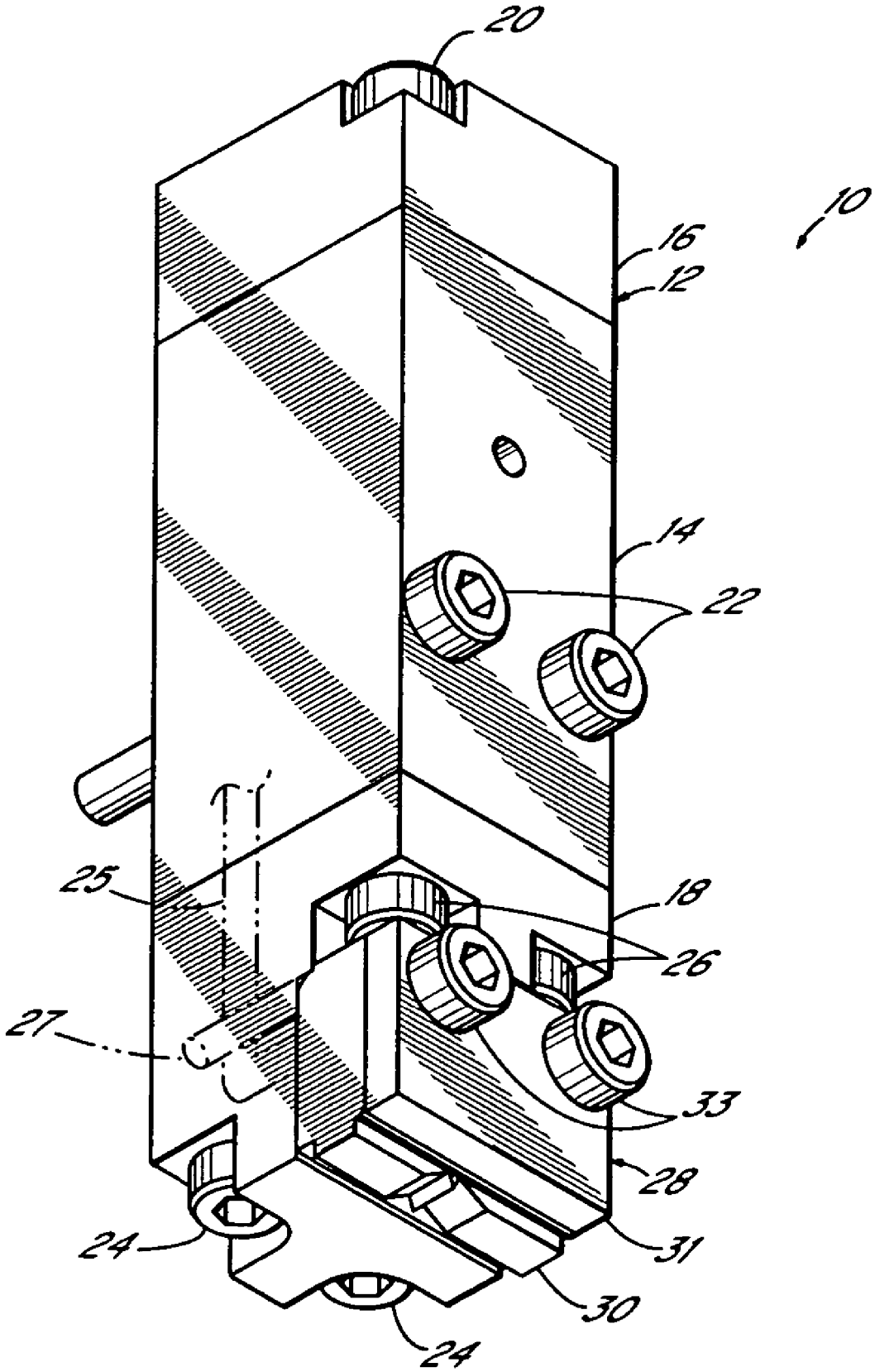
FIG. 1 is a perspective view of a dispensing module including one nozzle or die tip constructed in accordance with a preferred embodiment of the invention.

Referring first to FIG. 1, a dispensing module 10 is shown as constructed in accordance with the preferred embodiment. Dispensing module 10 generally comprises a module body 12 including a central body portion 14, an upper cap 16 and a lower body portion 18. Cap 16 is secured to central body portion 14 by fasteners 20. Central body portion 14 includes fasteners 22 for securing module 10 to a suitable support, such as a manifold (not shown) which supplies liquid, such as hot melt adhesive, to module 10. Lower body portion 18 is secured to central body portion 14 by respective pairs of fasteners 24, 26. A nozzle assembly or die tip assembly 28 receives liquid and pressurized air from respective supply passages 25, 27. Nozzle assembly 28 is secured to lower body portion 18 and includes a nozzle or die tip 30, a cover plate 31 for sealing respective liquid and air ports within nozzle or die tip 30. Cover plate 31 is secured to nozzle or die tip 30 by fasteners 33 and fasteners 33 further secure nozzle 30 and cover plate 31 to lower body portion 18. Module or applicator 10 is preferably of the on/off type and includes internal valve structure for selectively dispensing liquid, such as hot melt adhesive or other viscous liquid typically formed from polymeric material, in the form of one or more filaments. A suitable module structure usable in connection with nozzle 30 is part no. 309637 of Nordson Corporation, Westlake, Ohio, which is the assignee of the present invention.

Figure 2:
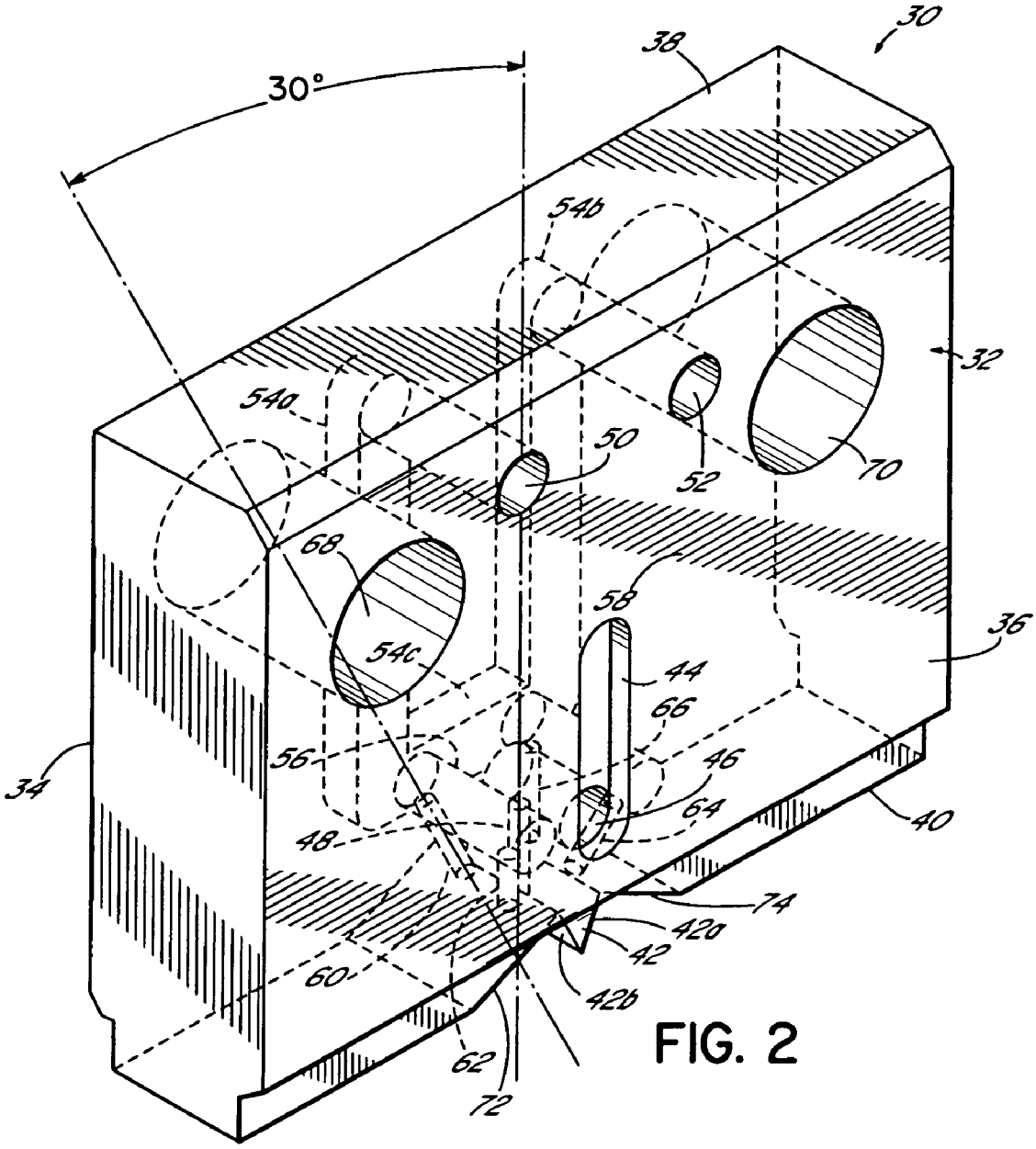
FIG. 2 is a perspective view of the nozzle or die tip of FIG. 1 with the cover plate removed.
Figure 3:
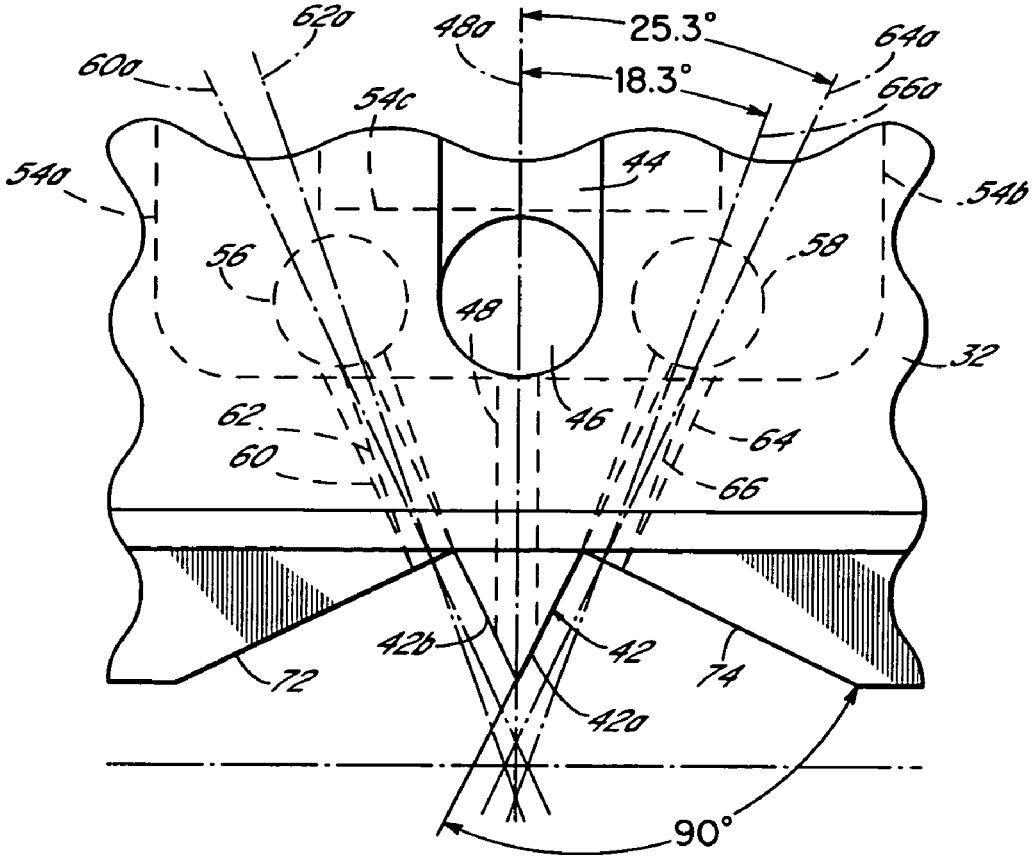
FIG. 3 is an enlarged, fragmented elevational view of the discharge end or portion of the nozzle or die tip shown in FIG. 2.
Figure 4:
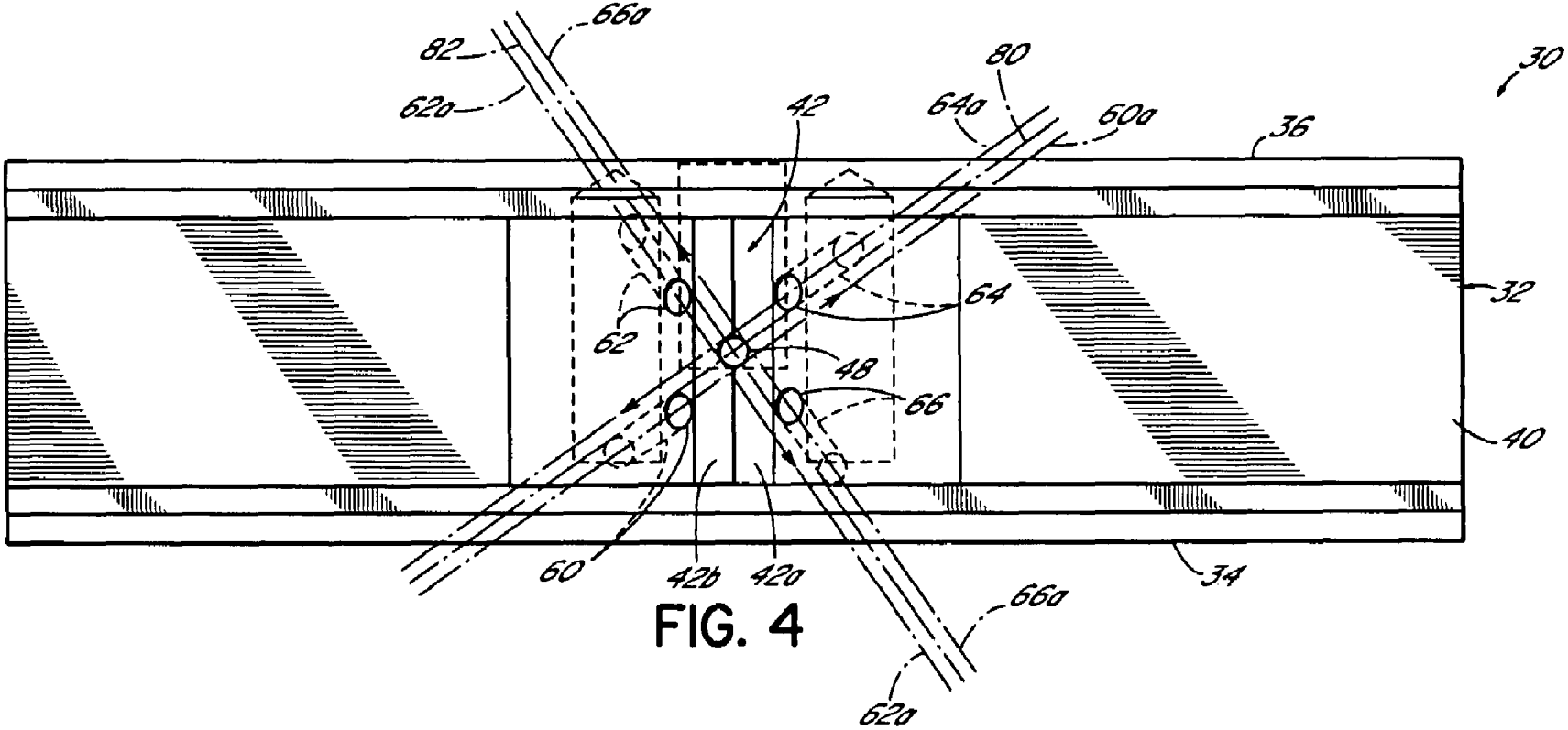
FIG. 4 is a bottom view of the nozzle or die tip shown in FIGS. 2 and 3.

Referring first to FIGS. 2-4, a nozzle 30 is shown constructed in accordance with the preferred embodiment. Nozzle 30 includes a body 32 preferably formed from a metal such as brass and having a front surface 34, a rear surface 36, an upper surface 38 and a lower surface 40. A wedge-shaped member 42 is formed on lower surface 40 is generally defined by a pair of converging side surfaces 42*a*, 42*b*. Rear surface 36 is adapted to be secured against the face of a dispenser and receives liquid material, such as hot melt adhesive, through a liquid inlet recess 44 communicating with a liquid inlet port 46 extending into body 32. Liquid inlet port 46 further communicates with a liquid discharge passage 48 having an axis 48*a* extending through wedge-shaped member 42. Air inlets 50, 52 also communicate between front and rear surfaces 34, 36 and lead to respective air supply recesses 54*a*, 54*b*, 54*c*. Recesses 54*a*, 54*b*, 54*c* communicate with a pair of air supply ports 56, 58 extending into body 32. Air supply ports 56, 58 communicate with four air discharge passages 60, 62, 64, 66 extending along respective axis 60*a*, 62*a*, 64*a*, 66*a*.

Air discharge passages 60, 62, 64, 66 exit on lower surface 40 adjacent the base of wedge-shaped member 42 as best shown in FIG. 3. Air discharge passages 60, 62, 64, 66 therefore discharge pressurized air generally along surfaces 42*a*, 42*b* with a compound angle as best comprehended by reviewing both FIGS. 3 and 4. Holes 68, 70 extend through body 32 for receiving fasteners (not shown) used to secure nozzle 30 to a dispenser. Wedge-shaped member 42 is positioned centrally between two angled surfaces 72, 74. Angled surfaces 72, 74 angle upwardly toward wedge-shaped member 42 such that the apex of wedge-shaped member 42 and the discharge outlet 48*b* of liquid discharge passage 48 is disposed generally at or above the lowest of lower surface 40 as shown in FIG. 3.

As viewed from the front of nozzle body 32 (FIG. 3), the axis 60*a*, 64*a* of air discharge passages 60, 64 are disposed preferably at 25.3° from the axis 48*a* of liquid discharge passage 48. The axis 62*a*, 66*a* of passages 62, 66 are preferably disposed at 18.3° from axis 48*a*. This difference in the angles as viewed from the front is due to the presence of an offset of the axis of each generally diametrically opposed air discharge passage 62, 66 and 60, 64 as shown in FIG. 4. The true angle of each air discharge passage 60, 62, 64, 66 relative to axis 48*a* in the preferred embodiment is 30° as shown in FIG. 2. In accordance with the invention, the axes 60*a*, 64*a* of respective air discharge passages 60, 64 are offset in opposite directions relative to an axis 80 which is normal to axis 48*a*. In the preferred embodiment, each axis 60*a*, 64*a* is offset by the same dimension from axis 80. When passages 48, 60, 62, 64, 66 have diameters in the range of 0.010 inch to 0.060 inch as is typical in the hot melt adhesive dispensing industry, for example, the minimum offset dimension is in a corresponding range of about 0.005 inch to about 0.030 inch. In the preferred embodiment, liquid discharge passage 48 has a diameter of 0.018 inch, as do air discharge passages 60, 62, 64, 66. The offset dimension of each air discharge passages 60, 62, 64, 66 with respect to axis 48 is 0.009 inch. Axes 62*a*, 66*a* are offset relative to an axis 82 to extending normal to axis 48*a* preferably by the same distance as axes 60*a*, 64*a* are offset from axis 48 as better illustrated by referring to axis 80 which is normal or perpendicular to axis 48 and parallel to axes 60*a*, 64*a*. However, it is also contemplated that different offset dimensions may be utilized between the various axes. For example, the offset dimensions between axes 60*a*, 64*a* and axis 80 may equal each other but may not equal the offset dimensions between axes 62*a*, 66*a* and axis 82. In other words, the offsets between axes 62*a*, 64*a* and axis 82 may equal each other but be smaller or larger than the offsets between axes 60, 64*a* and axis 80.

The four air discharge passages 60, 62, 64, 66 form a generally square pattern around the liquid discharge passage 48 at the base of wedge-shaped member 42. Diagonally opposite air discharge passages or, in other words, air discharge passages disposed at opposite corners of the square-shaped pattern are symmetric and disposed in planes are at least nearly parallel to each other. Air discharge passages 62, 66 and 60, 64, respectively, are each offset in the equal manner described above with respective axis 80, 82 such that the air stream discharged from each air discharge passage 60, 62, 64, 66 is tangential to the liquid filament or strand discharging from passage 48, as opposed to directly impacting the strand or filament discharging from passage 48. The larger the offset between axis 60*a*, 64*a* and axis 80, and between axis 62*a*, 66*a* and axis 82, the larger or more open is the liquid swirl pattern created. Preferred minimum offset is equal to the radius of any air discharge passages 60, 62, 64, 66. Preferably, the offset dimensions of the respective pairs of air discharge passages 60, 64 and 62, 66 are also equal.

Figure 4A:
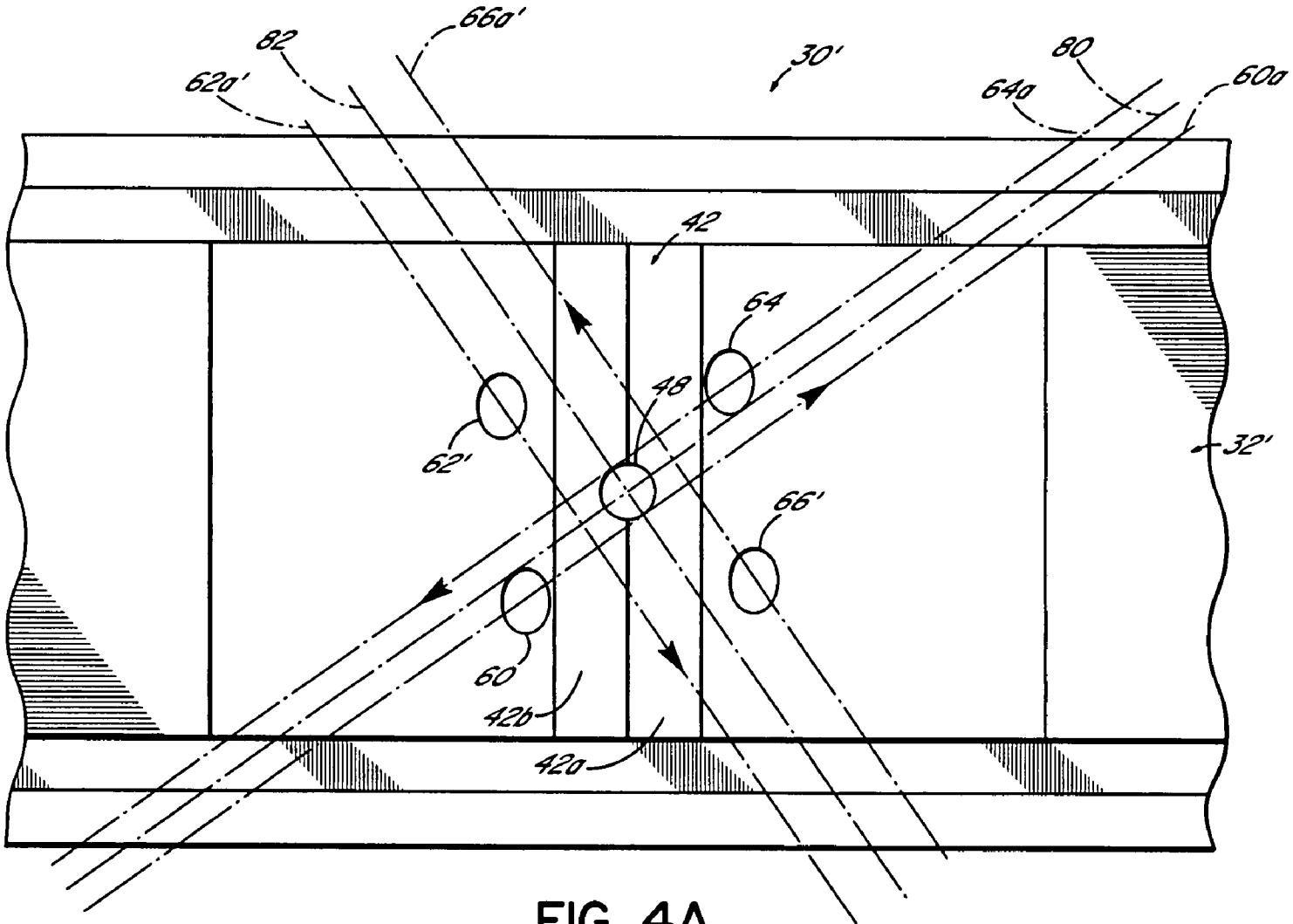
FIG. 4A illustrates a fragmented, enlarged bottom view of an alternative nozzle.

FIG. 4A illustrates an alternative nozzle 30' and, in this figure, like numerals refer to like elements with respect to the embodiment of FIGS. 1-4, while numerals with prime (') marks refer to elements that have been somewhat modified as discussed below. Specifically, liquid discharge passage 48 is again located at the apex of wedge-shaped member 42 and is surrounded by a generally square-shaped pattern of air discharge passages 60, 62', 64, 66'. In this embodiment, air discharge passages 60, 64 are each offset by a respective offset distance from axis 80 which is normal to the longitudinal axis of liquid discharge passage 48 and parallel to axes 60*a*, 64*a*. This offset distance may be the same as shown and described with respect to FIG. 4. On the other hand, air discharge passages 62', 66' each extend along respective axes 62*a*', 66*a*' which are offset by the same distance from axis 82 with respect to each other. However, as shown, this distance is greater than the offset distance of axes 60*a*, 64*a* from axis 80.

Figure 5:
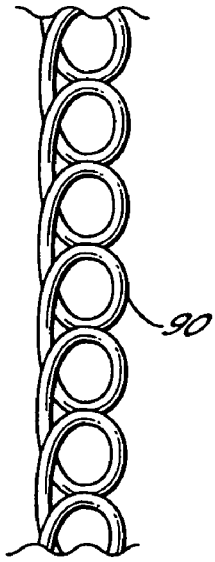
FIG. 5 is a schematic view of a swirled adhesive pattern as it would appear on a substrate after discharging from the dispensing module of FIG. 1.
Figure 6:
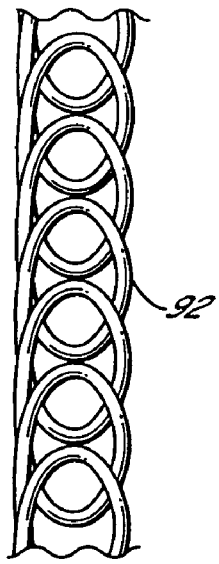
FIG. 6 is a swirled adhesive pattern as it would appear on a substrate after discharging from a dispensing module as shown in FIG. 1, but with a larger offset between the air discharge passages and the liquid discharge passage.
Figure 7:
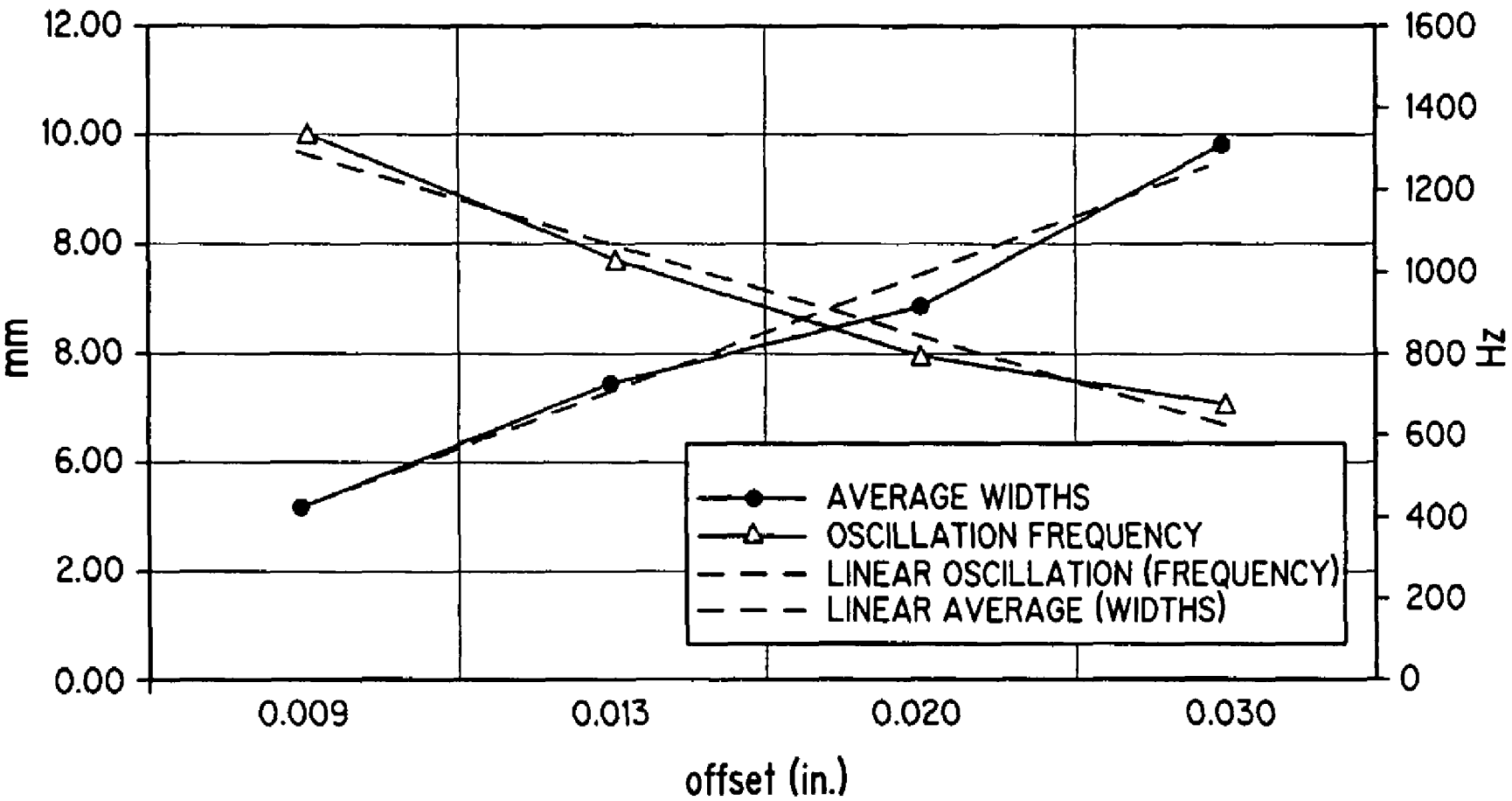
FIG. 7 is a graph illustrating the relationship between pattern width and offset dimension and between pattern oscillation frequency and offset dimension.

FIGS. 5 and 6 illustrate two different swirl patterns 90, 92 which are illustrative of the patterns formed using nozzle 30. Pattern 90 is illustrative of a tighter, smaller pattern of high frequency formed with lower offset dimensions. When the offset dimensions are increased, the swirled pattern of adhesive becomes more open creating a larger looping pattern of adhesive on the moving substrate (not shown), also having a lower frequency. FIG. 7 illustrates the relationship between the swirled adhesive pattern width and the offset dimension and between the oscillation frequency of the swirled adhesive pattern and the offset dimension for the nozzle 30 of FIG. 4. The dashed lines indicate the ideal linear relationship. It will be appreciated that the data indicates that a nearly linear relationship exists between the offset dimension and the resulting pattern width and frequency. For this reason, the design of nozzle 30 may be easily accomplished with relatively precisely predictable results in terms of both pattern width and pattern oscillation frequency.

Figure 8:
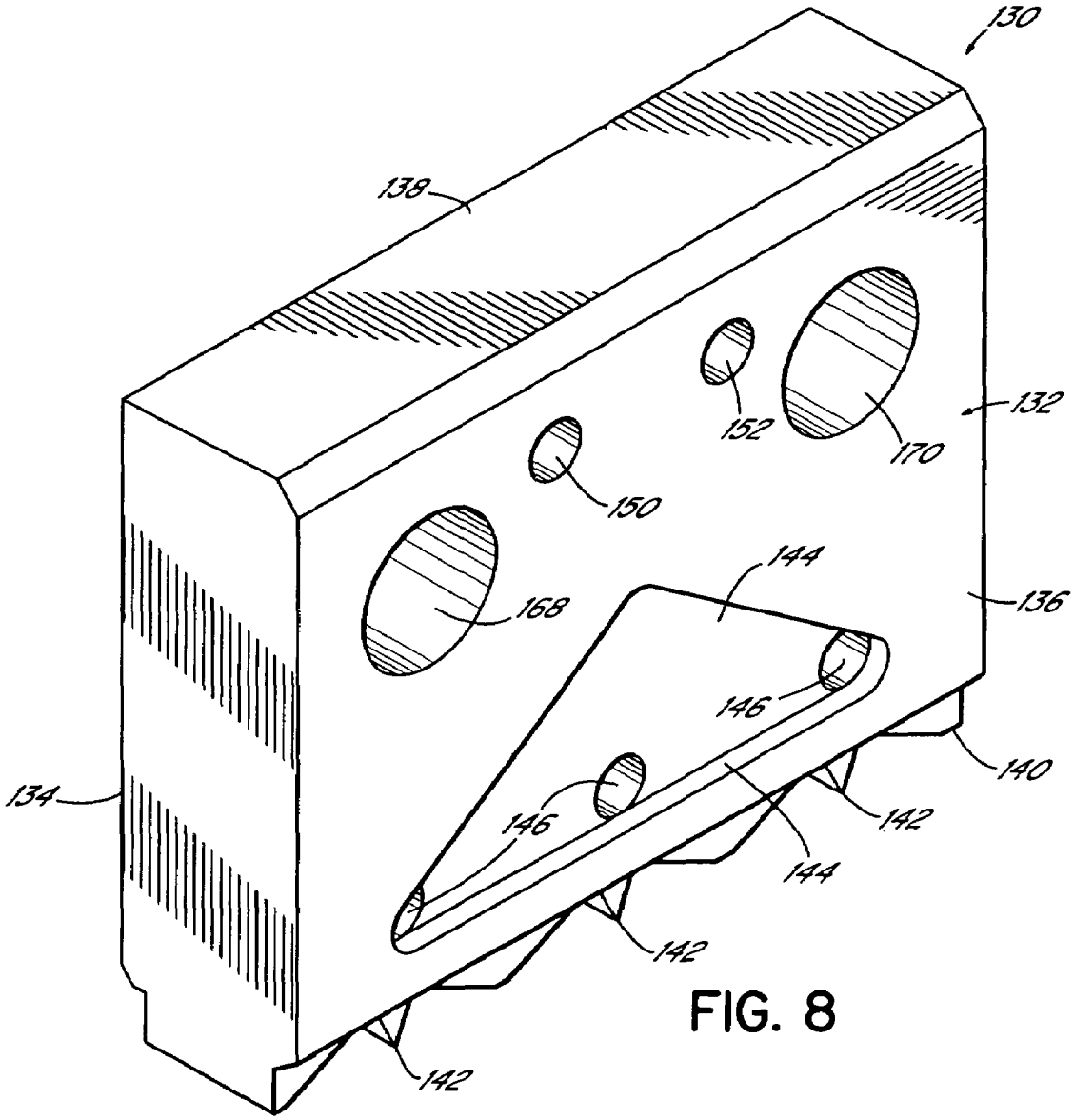
FIG. 8 is a perspective view of an alternative nozzle or die tip constructed in accordance with the invention.
Figure 9:
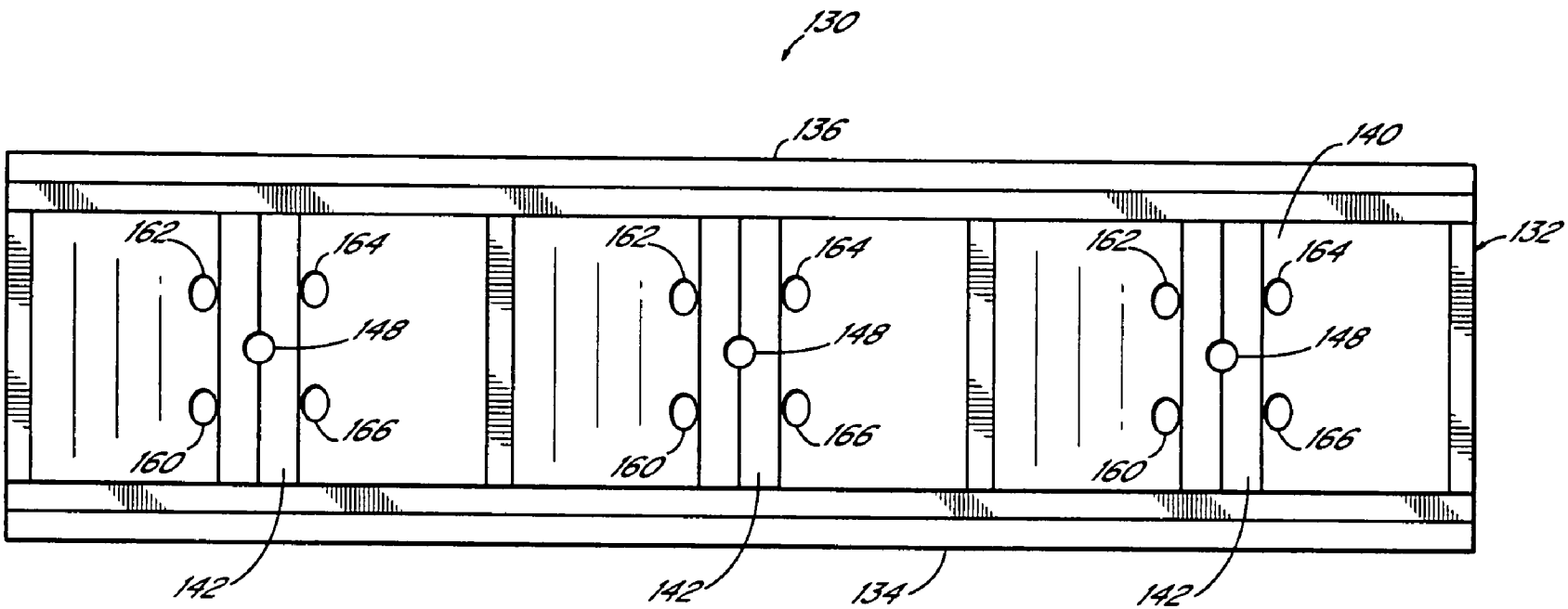
FIG. 9 is a bottom view of the nozzle or die tip shown in FIG. 8.

FIGS. 8 and 9 illustrate an alternative embodiment invention in the form of a nozzle 130. In FIGS. 8 and 9 like elements to the embodiment shown in FIGS. 1-4 are illustrated with like numerals except that such numerals are designated in "100" series. The only substantial difference between these two embodiments is that the embodiment of FIGS. 8 and 9 has been modified to emit or discharge more than one strand or filament of liquid material. Nozzle 130 comprises a nozzle body 132, a front surface 134, a rear surface 136, an upper surface 138 and a lower surface 140. Lower surface 140 includes a plurality of wedge-shaped members 142 configured as described with respect to the first embodiment. A liquid inlet recess 144 communicates with respective liquid supply ports 146 for feeding each of the plurality of liquid discharge passages 148 associated with the respective wedge-shaped members 142. Air inlets 150, 152 also communicate with respective air discharge passages 160, 162, 164, 166. Again, each of these air discharge passages 160, 162, 164, 166 is preferably oriented as described with respect to passages 60, 62, 64, 66 of the first embodiment. Holes 168, 170 are provided for receiving fasteners which secure nozzle 130 to a dispenser. Nozzle 130 allows multiple side-by-side swirled patterns of liquid, such as hot melt adhesive, to be dispensed onto a substrate moving relative to nozzle 130 at a position typically spaced below discharge passages 148. A particularly suitable application for the invention is the coating of strands, such as Lycra, used during the manufacture of diapers having elastic leg bands.

Figure 10:
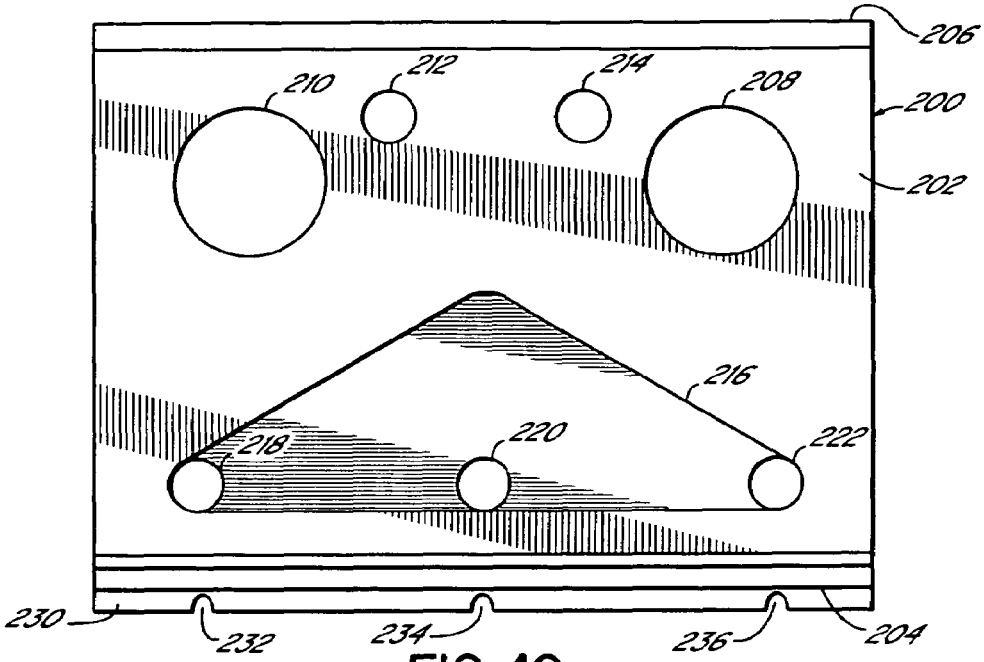
FIG. 10 is a rear elevational view of another alternative nozzle or die tip constructed in accordance with the invention.
Figure 11:
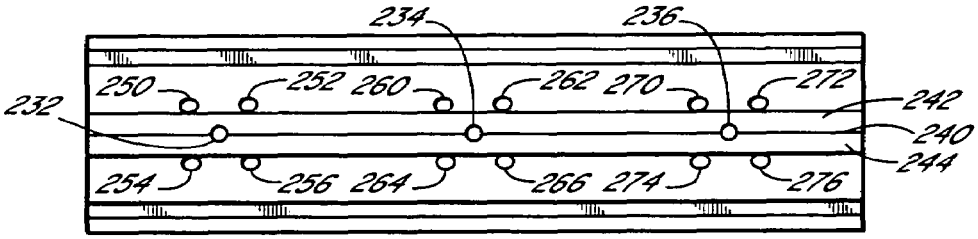
FIG. 11 is a bottom view of the nozzle or die tip shown in FIG. 10.
Figure 12:
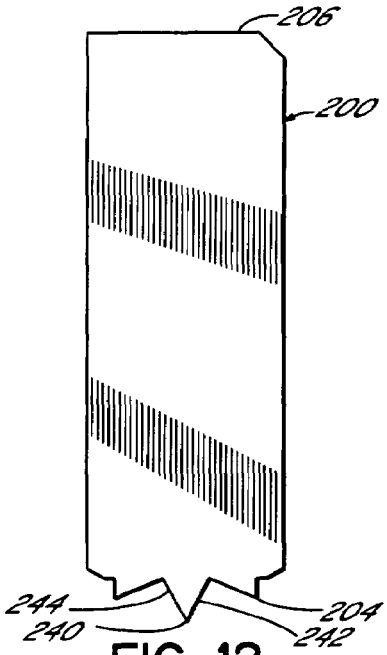
FIG. 12 is a side elevational view of the nozzle or die tip shown in FIGS. 10 and 11.

Referring to FIGS. 10-12, an alternative nozzle or die tip 200 includes a rear surface 202, a lower surface 204 and an upper surface 206. Respective holes 208, 210 are again provided for fasteners. Ports 212, 214 are again provided for supplying pressurized air. A recess 216 and ports 218, 220, 222 are provided for supplying pressurized liquid. Lower surface 204 includes a single wedge-shaped member 230 extending along the length of lower surface 204 and having multiple liquid discharge passages 232, 234, 236 extending in parallel along an apex 240 of wedge-shaped member 230. Wedge-shaped member 230 further includes respective converging side surfaces 242, 244. At the base of wedge-shaped member 230, respective sets of air discharge passages surround the liquid discharge passages 232, 234, 236 in a generally square shaped pattern. These sets comprise air discharge passages 250, 252, 254, 256 surrounding liquid discharge passage 232, air discharge passages 260, 262, 264, 266 surrounding liquid discharge passage 234, and air discharge passages 270, 272, 274, 276 surrounding liquid discharge passage 236.

With respect to each of these sets of air and liquid discharge passages, the angles, offset dimensions and configuration are preferably as described with respect to the previous embodiments. The embodiment of FIGS. 10-12 allows the use of a single wedge-shaped member 230 for producing multiple strands or filaments of swirled liquid.

While the present invention has been illustrated by a description of various preferred embodiments and while these embodiments has been described in some detail, it is not the intention of the Applicant to restrict or in any way limit the scope of the appended claims to such detail. Additional advantages and modifications will readily appear to those skilled in the art. The various features of the invention may be used alone or in numerous combinations depending on the needs and preferences of the user. This has been a description of the present invention, along with the preferred methods of practicing the present invention as currently known. However, the invention itself should only be defined by the appended claims, wherein.

What is claimed is:

1. A nozzle for dispensing multiple liquid filaments onto a moving substrate with a swirled pattern, comprising:

a nozzle body having a first side and a second side, said first side adapted for coupling to a dispenser body, and including a liquid inlet and an air inlet;

a recess formed in said second side of said nozzle body;

a surface on said second side of said nozzle body extending from within said recess;

at least one liquid discharge passage extending through said recess and having a central axis, said liquid discharge passage communicating with said liquid inlet and having a liquid discharge outlet proximate said surface; and a plurality of air discharge passages in said nozzle body, said air discharge passages communicating with said air inlet and opening into said recess adjacent said surface, said air discharge passages angled in a direction generally toward said liquid discharge outlet and having respective radii;

wherein air discharge passages that are located on diametrically opposite sides of said liquid discharge passage have longitudinal axes lying in parallel planes, and said respective planes are each offset from said central axis of said liquid discharge passage by a distance about equal to one of said radii of said air discharge passages.

2. The nozzle of claim 1, wherein said surface is inclined toward said liquid discharge outlet.

3. The nozzle of claim 1, wherein said surface comprises a projection extending from within said recess.

4. The nozzle of claim 1, wherein said plurality of air discharge passages have respective air discharge outlets positioned in a generally square pattern about said liquid discharge outlet.

5. The nozzle of claim 1, wherein each of said air discharge passages is offset the same distance from said central axis of said liquid discharge passage.

6. A module for dispensing multiple liquid filaments onto a moving substrate with a swirled pattern, comprising:

a dispenser body having a liquid supply passage and an air supply passage for respectively receiving liquid and air;

a nozzle body having a first side and a second side, said first side coupled to said dispenser body, and including a liquid inlet and an air inlet in communication with said respective liquid and air supply passages of said dispenser body;

a recess formed in said second side of said nozzle body;

a surface on said second side of said nozzle body and extending from within said recess;

at least one liquid discharge passage extending through said recess and having a central axis, said liquid discharge passage communicating with said liquid inlet and having a liquid discharge outlet proximate said surface; and a plurality of air discharge passages in said nozzle body, said air discharge passages communicating with said air inlet and opening into said recess adjacent said surface, said air discharge passages angled in a direction generally toward said liquid discharge outlet and having respective radii;

wherein air discharge passages that are located on diametrically opposite sides of said liquid discharge passage have longitudinal axes lying in parallel planes, and said respective planes are each offset from said central axis of said liquid discharge passage by a distance about equal to one of said radii of said air discharge passages.

7. The module of claim 6, wherein said surface is inclined toward said liquid discharge outlet.

8. The module of claim 6, wherein said surface comprises a projection extending from within said recess.

9. The module of claim 6, wherein said plurality of air discharge passages have respective air discharge outlets positioned in a generally square pattern about said liquid discharge outlet.

10. The module of claim 6, wherein each of said air discharge passages is offset the same distance from said central axis of said liquid discharge passage.

* * * * *